United States Patent [19]

Everett et al.

[11] Patent Number: 4,695,829

[45] Date of Patent: Sep. 22, 1987

[54] TEMPERATURE LEVEL INDICATING DEVICE AND METHOD OF MAKING THE SAME

[75] Inventors: Charles J. Everett, Clinton; Rolf H. Ochsner, Trumbull, both of Conn.

[73] Assignee: Robertshaw Controls Company, Richmond, Va.

[21] Appl. No.: 690,034

[22] Filed: Jan. 9, 1985

[51] Int. Cl.[4] ..... G08B 17/00

[52] U.S. Cl. ..... 340/586; 340/594; 340/693; 337/333; 337/376; 337/361

[58] Field of Search ..... 340/586, 593, 594, 693; 374/205, 188, 200; 337/333, 334, 335, 376, 361, 380; 116/334, 307, 315, DIG. 6, DIG. 21, DIG. 29, DIG. 31, 221; 403/289, 290, 354

[56] References Cited

U.S. PATENT DOCUMENTS

| | | | |
|---|---|---|---|
| 434,295 | 8/1890 | Richardi | 403/289 |
| 2,310,503 | 2/1943 | Widmer | 116/221 X |
| 2,806,108 | 9/1957 | Babson | 340/594 X |
| 3,171,109 | 2/1965 | Appel | 340/586 |
| 3,295,120 | 12/1966 | Witchie | 340/594 |
| 3,391,402 | 7/1988 | Lucas et al. | 340/594 |
| 3,611,334 | 10/1971 | Yankus | 340/593 |
| 3,745,545 | 7/1973 | Darbo | 340/594 |
| 3,763,481 | 10/1973 | Potorka, Sr. | 340/594 |
| 4,136,330 | 1/1979 | Estaque | 340/594 X |
| 4,560,972 | 12/1985 | Britt | 337/380 X |

OTHER PUBLICATIONS

Prior Known Device Which Can Have a Table Lamp Plugged into the Same.

*Primary Examiner*—James L. Rowland
*Assistant Examiner*—Jeffery A. Hofsass
*Attorney, Agent, or Firm*—Candor, Candor & Tassone

[57] ABSTRACT

A device for indicating that a sensed temperature has reached a certain selected level and method of making the same are provided, the device comprising a housing carrying an electrical switch unit for operating an indicator to one condition thereof when the switch unit is closed and to another condition thereof when the switch unit is open. The switch unit comprises a first movable contact unit and a second movable contact unit which when in contact with each other close the switch unit and when out of contact with each other open the switch unit. The first contact unit is moved relative to the second contact unit in relation to the sensed temperature. A selector unit is rotatably carried by the housing for selecting the certain level and has a setting portion operatively interconnected to the second contact unit to position the same relative to the first contact unit in relation to the selected level. The selector unit and the setting portion thereof comprise a one-piece selector member having a peripheral cam surface engaging the second contact unit to position the second contact unit relative to the first contact unit as the cam surface is rotated by the rotation of the selector member selecting the certain level.

11 Claims, 12 Drawing Figures

TEMPERATURE LEVEL INDICATING DEVICE AND METHOD OF MAKING THE SAME

BACKGROUND OF THE INVENTION

1. Field of the Invention

This invention relates to a new device for indicating that a sensed temperature has reached a certain selected level and to a new method of making such a device.

2. Prior Art Statement

It is known to provide a device for indicating that a sensed temperature has reached a certain selected level, the device comprising a housing means carrying an electrical switch means for operating an indicator means to one condition thereof when the switch means is closed and to another condition thereof when the switch means is open. The switch means comprises a first movable contact means and a second movable contact means which when in contact with each other close the switch means and when out of contact with each other open the switch means. The first contact means has means for moving the same relative to the second contact means in relation to the sensed temperature. A selector means is rotatably carried by the housing means for selecting the certain level and has setting means operatively interconnected to the second contact means to position the same relative to the first contact means in relation to the selected level. For example see the U.S. Patent to Witchie, U.S. Pat. No. 3,295,120 and the U.S. Patent to Darbo, U.S. Pat. No. 3,745,545.

It is also known to provide such a device where the indicating means can comprise a conventional table lamp or the like that is merely plugged into such device while the device itself is merely plugged into a conventional wall socket whereby the turning on of the lamp that can be viewed by a person outside the house or building using the device and will thereby indicate to that person that corrective measures must be taken.

It is also known to form a selector means that has a cam surface for operating on a bimetallic switch blade to set the temperature of operation of the same as a onepiece member. For example, see the U.S. patent to Babson, U.S. Pat. No. 2,806,108.

SUMMARY OF THE INVENTION

It is one feature of this invention to provide a new device for indicating that a sensed temperature has reached a certain selected level, such a device being particularly adapted to indicate that a heating system has failed to provide sufficient heat to prevent freezing of pipes and the like that would cause damage to the home or building being monitored by such a device. Such use as well as other uses for such a device is set forth in the aforementioned U.S. Pat. Nos. 3,295,120 and 3,745,545 whereby these two patents are being incorporated into this disclosure by this reference thereto.

In particular, it was found according to the teachings of this invention that a unique selector means for such a device can comprise a one-piece selector member that can be rotatably carried by the housing means for selecting the certain temperature level of the device and have a peripheral cam surface engaging one of the contact means of the switch means of the device to position that contact means relative to the other contact means as the cam surface is rotated by the rotation of the selector member selecting the certain temperature level.

For example, one embodiment of this invention provides a device for indicating that a sensed temperature has reached a certain selected level, the device comprising a housing means carrying an electrical switch means for operating an indicator means to one condition thereof when the switch means is closed and to another condition thereof when the switch means is open. The switch means comprises a first movable contact means and a second movable contact means which when in contact with each other close the switch means and when out of contact with each other open the switch means. The first contact means has means for moving the same relative to the second contact means in relation to the sensed temperature. A selector means is rotatably carried by the housing means for selecting the certain level and has setting means operatively interconnected to the second contact means to position the same relative to the first contact means in relation to the selected level. The selector means and the setting means comprise a one-piece selector member having a peripheral cam surface engaging the second contact means to position the second contact means relative to the first contact means as the cam surface is rotated by the rotation of the selector member selecting the certain level.

The selector member has a substantially cylindrical portion provided with opposed ends. The housing means has a cylindrical projection provided with an internal annular surface, the cylindrical projection telescopically receiving one of the ends of the cylindrical portion therein to rotatably mount the selector member to the housing means by the one end rotatably engaging the internal annular surface of the cylindrical projection. The housing means has a snap-fit projection extending concentrically out of the cylindrical projection in radially inwardly spaced relation to the internal annular surface of the cylindrical projection. The cylindrical portion has an opening passing therethrough and through the ends thereof. The snap-fit projection extends into the opening and is snap-fitted to the other end of the cylindrical projection.

Accordingly, it is an object of this invention to provide a new device for indicating that a sensed temperature has reached a certain selected level, the device of this invention having one or more of the novel features of this invention as set forth above or hereinafter shown or described.

Another object of this invention is to provide a new method of making a device for indicating that a sensed temperature has reached a certain selected level, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
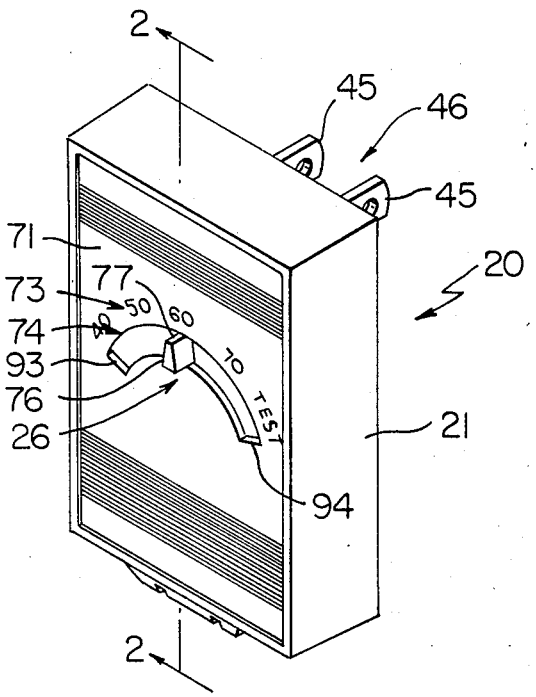
FIG. 1 is a perspective view of the new device of this invention for indicating that a sensed temperature has reached a certain selected level.

While the various features of this invention are hereinafter illustrated and described as being particularly adapted to provide a device for indicating that a sensed temperature has reached a certain selected temperature level in order to indicate an unsafe condition of the heating and/or cooling means of a home or building, it is to be understood that the various features of this invention can be utilized singly or in various combinations thereof to provide a device for indicating that a sensed temperature has reached a certain selected temperature level for other purposes.

Also, while the device of this invention is hereafter illustrated and described as having the indicating means thereof comprise a lamp that is plugged into the device, it is to be understood that the indicating means thereof could be other signal means, such as an alarm, etc. that has been plugged into the device of this invention.

Therefore, this invention is not to be limited to only the embodiments illustrated in the drawings, because the drawings are merely utilized to illustrate one of the wide variety of this invention.

Figure 2:
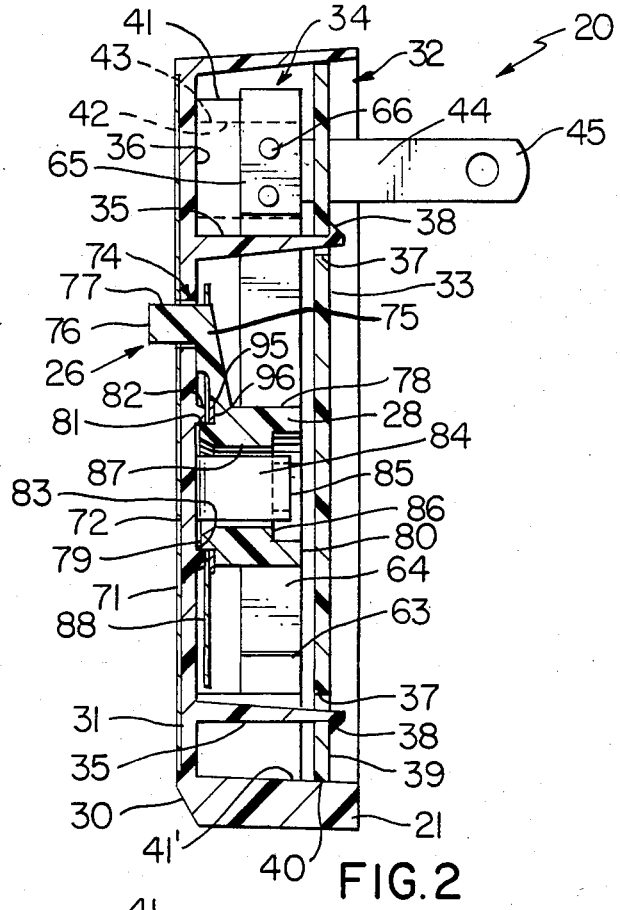
FIG. 2 is an enlarged cross-sectional view taken on line 2—2 of FIG. 1.
Figure 3:
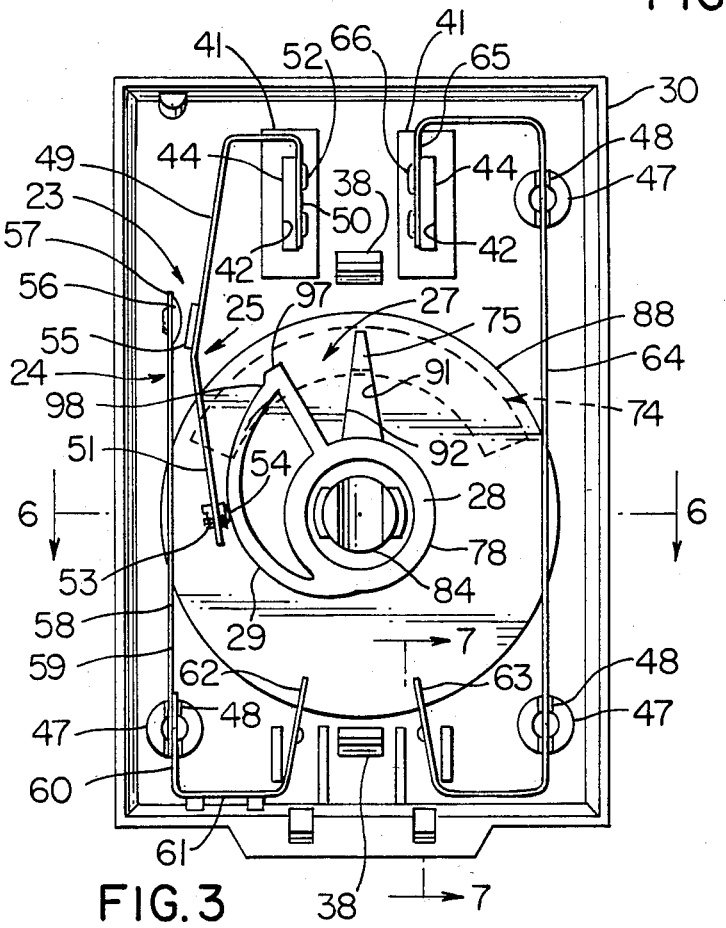
FIG. 3 is a rear view of the device illustrated in FIG. 2 with the rear cover thereof removed and illustrating the device in an operating condition thereof wherein the switch means thereof is open.
Figure 4:
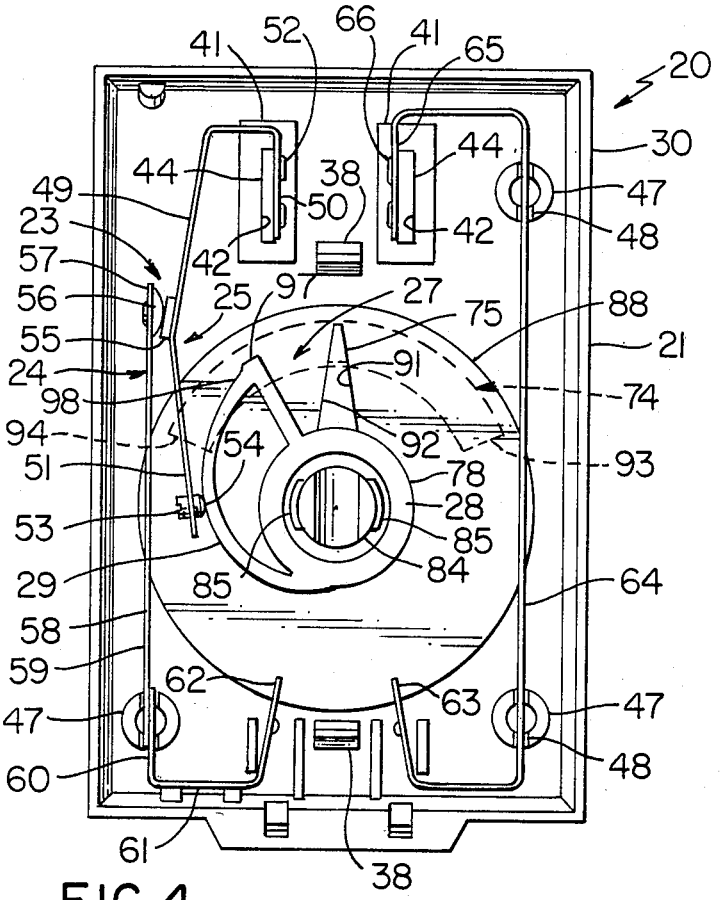
FIG. 4 is a view similar to FIG. 3 and illustrates the device with the switch means thereof closed.
Figure 7:
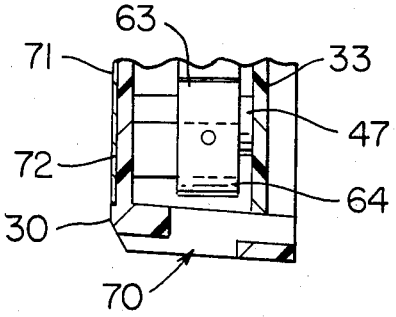
FIG. 7 is a fragmentary cross-sectional view taken on line 7—7 of FIG. 3.
Figure 10:
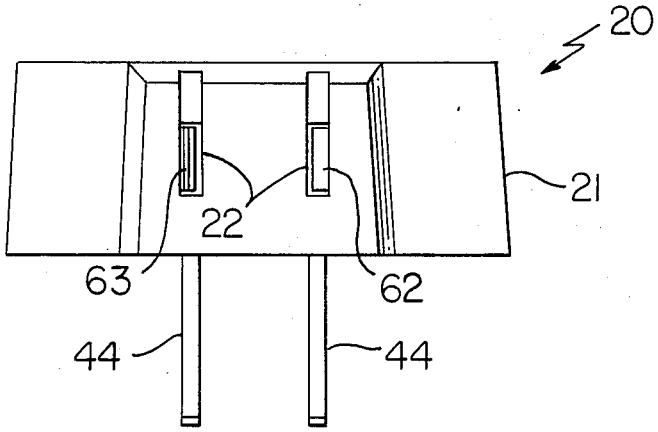
FIG. 10 is a bottom view of the device of FIG. 1.

Referring now to FIGS. 1–3, the new device of this invention for indicating that a sensed temperature has reached a certain selected level is generally indicated by the reference numeral 20 and comprises a housing means 21 carrying an electrical switch means that is generally indicated by the reference numeral 23, FIG. 3, for operating an indicator means (not shown) to one condition thereof when the switch means is closed as illustrated in FIG. 4 and to another condition thereof when the switch means is open as illustrated in FIG. 3, the indicator means comprising a lamp or the like that is plugged into the socket openings 22 formed in the bottom of the housing means 21 as best illustrated in FIG. 10.

The switch means 23 comprises a first movable contact means that is generally indicated by the reference numeral 24 and a second movable contact means that is generally indicated by the reference numeral 25 which when in contact with each other as illustrated in FIG. 4 close the switch means 23 and when out of contact with each other open the switch means 23 as illustrated in FIG. 3, the first contact means 24 having means for moving the same relative to the second contact means 25 in relation to sensed temperature in a manner hereinafter set forth.

The device 20 has a selector means that is generally indicated by the reference numeral 26 and is rotatably carried by the housing means 21 in a manner hereinafter set forth for selecting a certain temperature level, the selector means 26 having setting means that is generally indicated by the reference numeral 27 in FIG. 3 and is operatively interconnected to the second contact means 25 to position the same relative to the first contact means 24 in relation to the selected temperature level.

In particular, the selector means 26 and setting means 27 of this invention uniquely comprise a one-piece selector member 28 that has a peripheral cam surface 29 engaging the second contact means 25 to position the second contact means 25 relative to the first contact means 24 as the cam surface 29 is rotated by the rotation of the selector member 28 during a selection of a certain temperature level as hereinafter set forth, the selector member 28 being formed of any suitable electrically insulating material and being molded into the configuration illustrated in the drawings.

The housing means 21 of the device 20 of this invention comprises a rectangular cup-shaped member 30 formed of any suitable electrically insulating material and having a closed end 31 and an open end 32 closed by a rear closure member or panel 33 also formed of any suitable electrically insulating material, the housing members 30 and 33 cooperating together to define a chamber 34 within the housing means 21.

While the rear closure 33 can be secured to the cup-shaped housing member 30 in any suitable manner, the cup-shaped housing member 30 has a pair of spaced apart projections 35 extending rearwardly from the inside surface 36 of the end wall 31 and respectively projecting through suitable slots 37 in the end wall 33 to have hook ends 38 thereof hook against the rear surface 39 of the wall 33 to hold the same with its outer peripheral portion 40 in wedging contact with the tapering internal annular side wall surface 41' of the cup-shaped housing member 30. In this manner, the rear wall 33 can be simply and effectively snap-fit in place by the hook ends 38 of the projections 35 snapping through the openings 37.

The cup-shaped housing member 30 has a pair of spaced apart projections 41 extending from the inside surface 36 thereof and being respectively provided with openings 42 which respectively receive ends 43 of a pair of terminal members 44 which have the other ends 45 thereof projecting out through suitable openings (not shown) in the end wall 33 to provide a plug-in arrangement for the device 20 that is generally indicated by the reference numeral 46 in FIG. 1 and that is adapted to be plugged into a conventional electrical outlet of a home, building, etc., as well as be plugged into an extension cord so that the device 20 can be electrically interconnected by the terminal members 44 to an electrical power source, such as the conventional house current etc. Of course, it is to be understood that the electrical power source for the device 20 of this invention could be a battery if desired that would electrically interconnect the teminals 44 together.

The terminal ends 43 of the terminals 44 can be secured in the openings 42 of the projections in any suitable manner, such as by adhesive means, press-fitting, etc. Of course, the ends 43 could be molded in place during the molding of the cup-shaped housing member 30, if desired.

A plurality of post-like projections 47 also extend from the inside surface 36 of the cup-shaped housing member 30 and each has a slot means 48 extending across the free end of the same to press-fittingly receive structure therein to hold the same in the chamber 34 of the housing means 20 in a manner hereinafter described, the projections 35, 41 and 47 being integral and one-piece with the cup-shaped housing member 30 and being effectively formed during the molding operation that forms the housing member 30.

The second contact means 25 of the switch means 23 of device 20 comprises a flexible metallic switch blade 49 having opposed ends 50 and 51 and being bent in the configuration illustrated in FIG. 3, the end 50 of the switch blade 49 being secured to one of the terminals 44 by rivet of spot weld means 52 while the other end 51 thereof carries a threaded adjusting member 53 that has an arcuate end 54 bearing against the cam surface 29 of the selector member 28 as the switch blade 49 has a normal bias tending to move the end 51 thereof toward the cam surface 29 as illustrated in FIG. 3 whereby the second contact means 25 is always operatively in engagement with the cam surface 29 through the adjusting member 53.

The switch blade 49 carries an electrical contact 55 intermediate the ends 50 and 51 thereof with the contact 55 being adapted to cooperate with a contact 56 carried on the free end 57 of a bimetallic switch blade 58 that has its other end 59 secured by spot welding or other means to an end 60 of a U-shaped conductive blade member 61, the bimetallic switch blade 58 and its contact 56 comprising the first contact means 24 and having the joint area between the end 59 thereof and the end 60 of the leaf member 61 press-fittingly secured in the slot means 48 of one of the posts 47 so that that post 47 holds the bimetallic switch blade 58 in a cantilevered manner for a purpose hereinafter described.

The U-shaped metallic leaf member 61 has its other end 62 disposed spaced from and substantially parallel to a like end 63 of another metallic leaf blade member 64 that is bent in the configuration illustrated in FIG. 3 and that has its other end 65 secured to the other terminal 44 by rivet or spot weld means 66 as illustrated, the leaf member 64 having portions thereof press-fittingly disposed and secured in the slot means 48 of the remaining posts 47 as illustrated in FIG. 3.

In this manner, a lamp or the like can have the plug of its electrical cord plugged into the plug slots 22 in the bottom wall 67 of the device 20 whereby the two prongs (not shown) of the lamp plug will respectively engage against the ends 62 and 63 of the leaf members 61 and 64 and remain in electrical contact therewith as long as the lamp plug is plugged into the plug slots 22. With the device 20 having its terminals 44 in turn, plugged into a wall socket and with the lamp switch turned "on", the device 20 will cause the indicating lamp to be lit and shine through a window of the building or home containing the same to visually indicate that the temperature sensed by the bimetal switch blade 58 has reached a certain selected level as selected by the selector member 28 in a manner hereinafter set forth.

It is to be understood that instead of utilizing a lamp or the like other types of electrically operatable indicating means could be utilized with the device 20 of this invention by merely being plugged into the slots 22 thereof, such as a sound producing alarm device, as desired.

Figure 11:
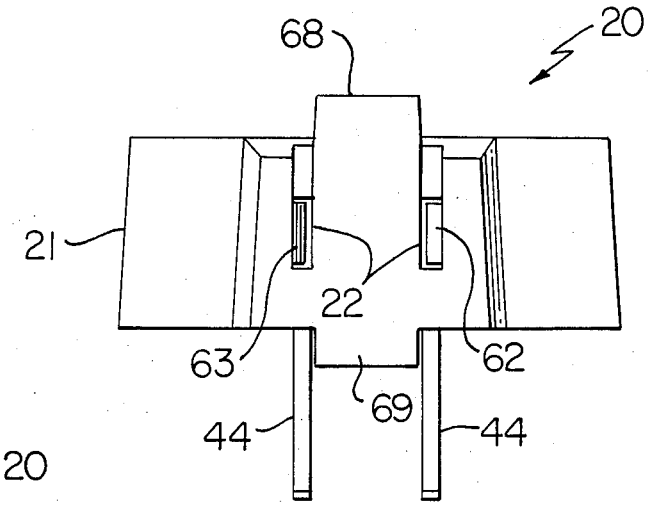
FIG. 11 is a view similar to FIG. 10 and illustrates another embodiment of the device of this invention.
Figure 12:
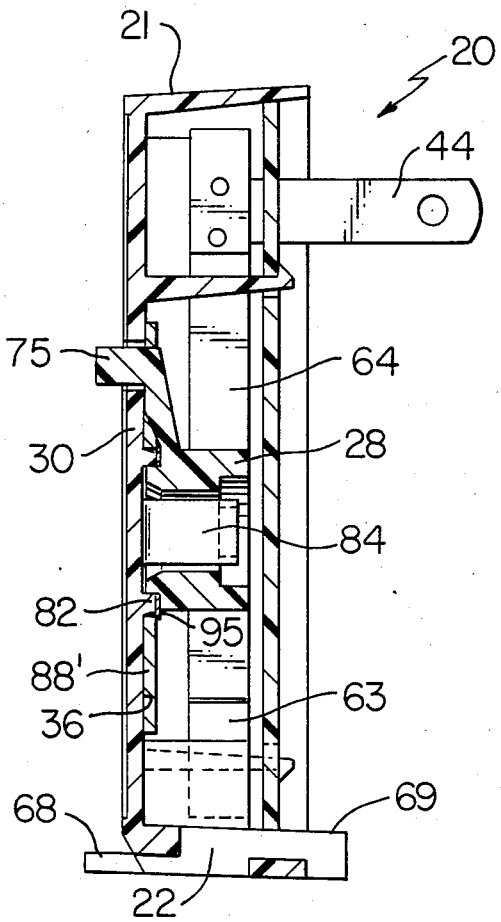
FIG. 12 is a view similar to FIG. 2 and illustrates the device of FIG. 11.

It has been found that it is preferred to prevent a lamp with a grounded plug (i.e., one that has three prongs) from being plugged into the device 20 of this invention whereby the housing means 21 can be formed with a pair of outwardly projecting tabs 68 and 79 as illustrated in FIGS. 11 and 12 so that the ground prong of such three prong grounded plug will engage against one of the tabs 68 or 69 and thereby prevent the other prongs thereof from being inserted into the slots 22.

As illustrated in FIG. 4, when the contacts 55 and 56 are disposed against each other to close the switch means 23, the two terminals 44 are electrically interconnected together through the closed switch means 23 and the indicating lamp to cause the light thereof to be lit for the previously described purpose. However, when the contacts 55 and 56 are disposed apart so as to open the switch means 23, it can be seen that the terminals 44 are disconnected from each other by the open switch means 23 so that no current can flow through the light bulb means of the indicating lamp to light the same.

A cover plate 71 is secured to the front surface 72 of the end wall 31 of the housing member 30 and has a temperature scale 73 provided thereon and disposed adjacent an arcuate slot means 74 which passes through the cover plate 71 and the end wall 31 so as to have a handle portion 75 of the selector member 28 project therethrough. In this manner, a person can grasp the outer end 76 of the handle portion 75 and position an upper pointer-like surface 77 thereof adjacent a desired temperature on the scale 73 to select the certain temperature level that the device 20 will indicate has been reached by the temperature sensing blade 58 having sensed such temperature adjacent the device 20 to cause the light bulb means of the indicating lamp to be illuminated by the switch means 23 being closed in a manner hereinafter set forth.

The one-piece selector member 28 has a substantially cylindrical body portion 78 provided with opposed ends 79 and 80, the end 79 having a reduced annular surface 81 telescopically received within a cylindrical projection 82 that extends outwardly from the rear surface 36 of the end wall 31 of the housing member 30 so that its annular surface 83 is engaged by the annular surface 81 of the cylindrical portion 79 to rotatably mount the selector member 28 to the housing means 21. Thus, arcuate movement of the handle portion 75 of the selector member 28 in the arcuate slot means 74 to position the pointer surface 77 relative to the temperature scale 73 actually causes the member 28 to rotate on its annular surface 81 and thereby move the cam surface 29 thereof relative to the end 54 of the threaded adjusting member 53 on the end 51 of the switch blade 49 to position the contact 55 thereof relative to the contact 56 and thereby cause the switch means 23 to close when the bimetal member 58 senses a temperature that corresponds to the temperature selected by the handle portion 75 of the selector member 28 being positioned relative to the scale 73.

A bifurcated projection 84 extends concentrically from within the cylindrical projection 82 and is formed integrally with the end wall 31 of the housing member 30, the projection 84 having a pair of opposed hooking ends 85 for hooking against an annular end surface 86 formed at the end 80 of the selector member 28, the cylindrical portion 78 of the selector member 28 having a cylndrical opening 87 passing centrally therethrough and interrupting the ends 79 and 80 thereof so as to receive the bifurcated projection 84 of the housing member 30 therein as illustrated.

In this manner, the selector member 28 can be snap-fitted onto the projection 84 of the housing member 30 as the same is being telescopically disposed over the projection 84 and having its annular surface 81 being inserted into the annular surface 83 of the housing member 30 as illustrated. In this manner, the selector member 28 will be rotatably secured to the housing member 30 by the tongues 85 snap-fitting against the annular surface 86 thereof as they project out through the opening 87.

However, before the selector member 28 is so snap-fitted to the housing means 30, a cover disc 88 formed of any suitable material, such as plastic, is telescopically disposed on the annular surface 81 of the selector member 28 by having a central opening 89 formed therethrough as well as an interconnecting inverted V-shaped notch 90 which receives the handle portion 75 of the selector member 28 therethrough which is shaped to engage the opposed sides 91 and 92 of the notch 90 whereby the disc 88 will rotate in unison with the selector member 28 as the handle portion 75 is moved in the slot means 74. In this manner, it can be seen that the disc 88 closes the slot means 74 on opposite sides of the handle portion 75 during movement of the handle portion 75 from one end 93 of the slot means 74 to the other end 94 thereof so that no opening is provided through the slot means 74 to inadvertently provide an access to the interior of the chamber 34.

In addition, an arcuate annular spring washer-like member 95 is telescoped on the annular surface 81 of the selector member 28 intermediate the disc 88 thereof and an annular shoulder 96 of the selector member 28 so as to provide a compressed spring force tending to move the selector member 28 out of the annular projection 82 of the housing member 30 and thereby force the annular surface 86 against the tongues 85 of the bifurcated projection 84 so that "feel" is provided for the selector 28 during the rotational movement thereof as well as provide friction that will hold the selector member 28 in the selected rotational position thereof, the spring means 95 tending to force the selector member 28 away from the end wall 31 of the housing member 30 because the spring 95 is placed under compression during the snap-fit arrangement of the selector member 28 on the projection 84.

However, it has been found that it is preferred to form the cover disc 88 from a fire proof fiber material and because such a formed disc 88' as illustrated in FIG. 12 is substantially thicker than the plastic disc 88, the fiber disc 88' can be rotatably mounted on the cylindrical projection 82 of the rear surface 36 of the housing member 30 as illustrated in FIG. 12 with the handle portion 75 of the selector member 28 rotating the same for the same purpose as the disc 88 previously discussed, the spring washer-like member 95 still performing its function in the device of FIG. 12 in the same manner as previously described.

Figure 5:
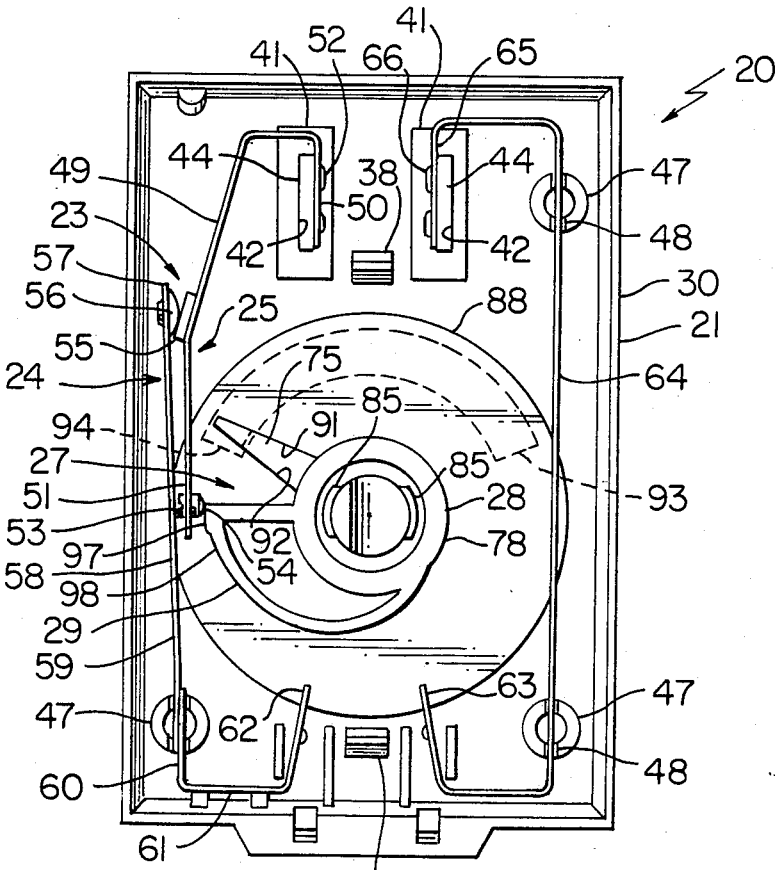
FIG. 5 is a view similar to FIG. 4 and illustrates the device when same is disposed in an indicating "test" condition thereof.
Figure 6:
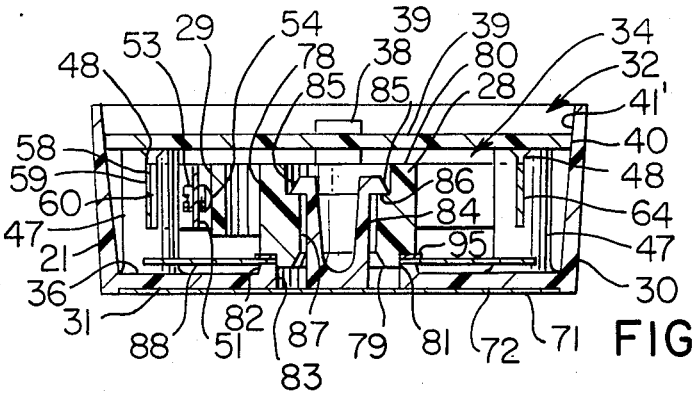
FIG. 6 is a cross-sectional view taken on line 6—6 of FIG. 3.
Figure 8:
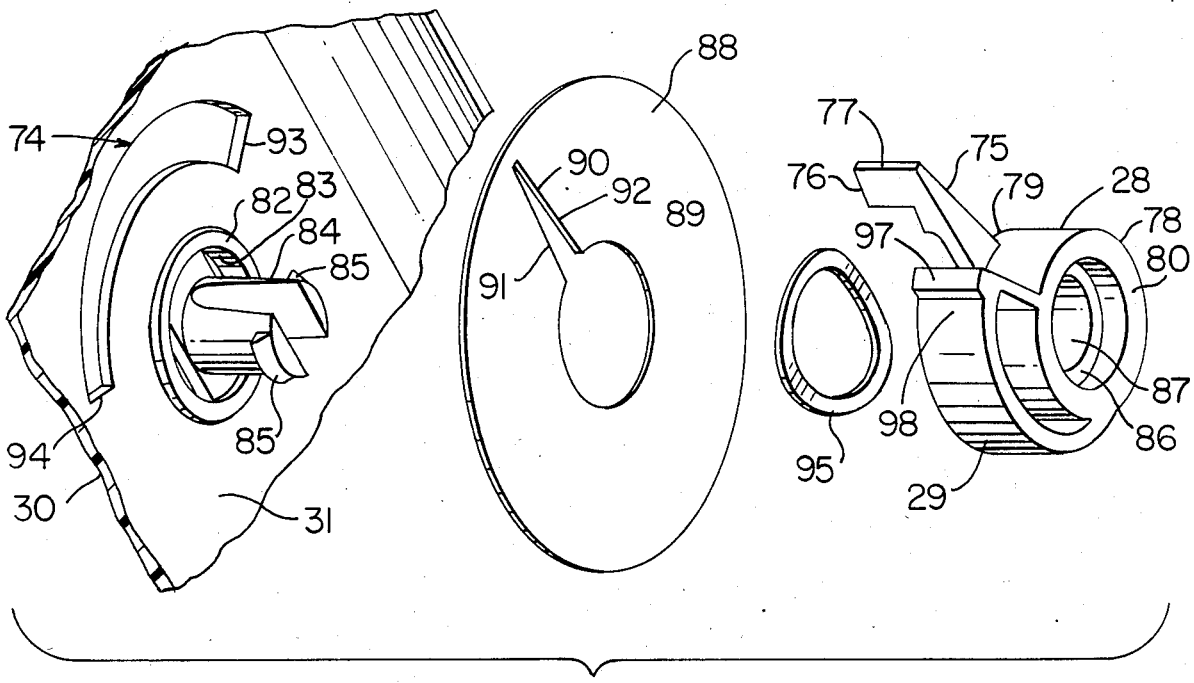
FIG. 8 is a fragmentary exploded perspective view of the selector means of the device of FIGS. 1–3.

The cam surface 29 of the selector member 28 is provided with a high lobe or projection 97 at the high side 98 of the cam surface 29 so as to always force the second contact means 25 into contact with the first contact means 24 regardless of the temperature being sensed by the bimetal blade 58 so that the switch means 23 will be closed in the manner illustrated in FIG. 5 to test that the light bulb means of the plugged in indicating lamp or the like is operative to illuminate when the switch means 23 is closed, the selector means 28 being moved to such "test" position when the handle member 75 is moved to the end 94 of the slot means 74 where the word "test" of the scale 73 will be adjacent the pointer surface 77 of the handle means 75.

From the above, it can be seen that the device 20 of this invention can readily be formed from the various parts thereof by the method of this invention previously described so as to operate in a manner now to be described.

When the device 20 is electrically interconnected to an electrical power source by the plug-in arrangement 46 thereof either being directly plugged into a wall socket or into an extension cord that is itself plugged into a wall socket and an indicating lamp is plugged into the plug slots 22 of the device 20 and is positioned in the desired room or area for viewing thereof to indicate that the selected temperature level has been or has not been reached, the operator sets the handle portion 75 of the selector member 28 to the desired temperature on the scale 73 so that the device 20 will indicate through the illumination of the light bulb means of the indicating lamp that such selected temperature in the area of the device 20 has now been reached and that such situation should be corrected.

For example, should it be desired that the heating unit for the building containing the device 20 should not be producing an output temperature effect that falls below 60° F., the operator positions the handle portion 75 of the selector member 28 so that the pointer surface 77 thereof is adjacent the designation "60" as illustrated in FIG. 1.

In this manner, a particular portion of the cam surface 29 is disposed adjacent the end 51 of the switch blade 49 so that the contact 55 of the contact means 25 is properly positioned relative to the contact 56 of the first contact means 24 so that should the bimetal member 58 be sensing a temperature of 60° or less, the bimetal member 58 will be warped in such a manner that the same is placing the contact 56 thereof against the contact 55 as illustrated in FIG. 4 so as to close the switch means 23.

However, as long as the temperature being sensed by the bimetal blade 58 is above the selected temperature of 60°, the bimetal member 58 is warped in a manner to cause the contact 56 to be disposed out of contact with the contact 55 as illustrated in FIG. 3 so that no current can flow through the light bulb means of the plugged in indicating lamp. Once the sensed temperature level of 60° or less is being sensed by the bimetal member 58, such temperature has caused the bimetal blade 58 to dispose its contact 56 against the contact 55 as illustrated in FIG. 4 and thereby complete an electrical circuit through the light bulb means of the indicating lamp from one terminal 44 to the other terminal 44 whereby the light bulb means of the indicating lamp will light and glow through the window of the house or building to indicate to a person outside the same that the temperature in the area being monitored by the device 20 is below the selected temperature level and that the heating unit for the building containing the device 20 requires attention.

When the heating unit has the operation thereof corrected, and the same is producing an output temperature effect above 60° F., the bimetal member 58 of the device 20 will move the contact 56 away from the contact 55 and hold the same away from the contact 55 so that the switch means 23 is in the open condition illustrated in FIG. 3 and the light bulb means of the indicating lamp is in an unlit condition thereof indicating that the output effect of the heating unit is above the selected temperature level is provided by the position of the handle portion 75 adjacent the scale 73 of the device 20.

Should a person desire to make sure that the light bulb means of the indicating lamp is still a good bulb means and that the same will light when the switch means 23 of the respective device 20 closes, that person can grasp the handle 75 and rotate the selector member 28 to the "test" position at the end 94 of the slot 74 as illustrated in FIG. 5 whereby the high projection or lobe 97 on the cam surface 98 will act against the end 51 of the switch blade 49 to force the contact 55 into contact with the contact 56 regardless of the temperature being sensed by the bimetal member 58 so that the switch means 23 will be closed and the light bulb means will be lit if the light bulb means of the indicating lamp is "good" and that an electrical current is being supplied to the terminals 44. Should such test operation of the device 20 prove that the light bulb means of the indicating lamp will operate when the switch means 23 is closed, the operator then moves the selector handle 75 to the desired temperature on the scale 73 for which the device 20 is to cause the light bulb means to operate in the manner previously described.

While the adjusting screw 53 provides the means for having the end 51 of the switch blade 49 engage against the cam surface 29 of the selector member 28, it is to be understood that the adjusting member 53 can be utilized to calibrate the device 20 at set point and reduce the effect of parts tolerances.

While the device 20 previously described indicates a temperature that has gone below a selected level by having the gap between the contacts 55 and 56 decrease on decreasing temperature, it is to be understood that the device 20 can be modified to provide an indication on temperature rise by merely changing the bimetal member 58 around to move toward the contact 55 on rising temperature rather than away for the indication on temperature fall whereby such modified device 20 would indicate that a cooling unit is failing to maintain a certain selected temperature.

In addition, the device 20 could be modified to have the plugged in indication means thereof produce an indication that either the sensed temperature has risen to a certain high temperature or has fallen to a certain low temperature by having the second contact means 25 comprise a pair of spaced apart contacts with the contact 56 of the first contact means 24 disposed therebetween.

Figure 9:
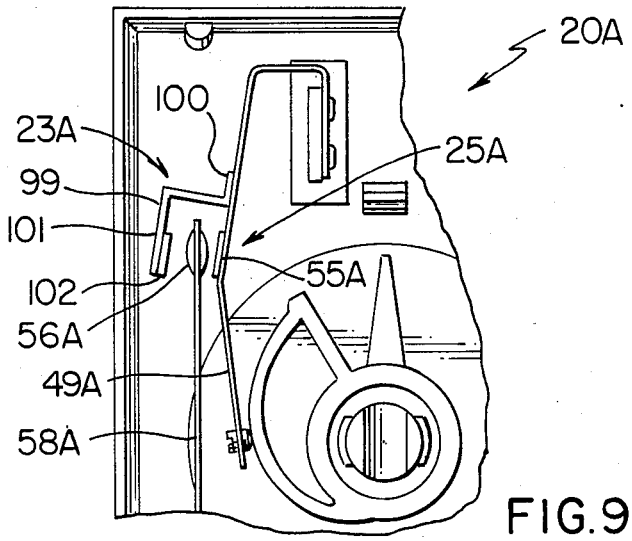
FIG. 9 is a fragmentary view similar to FIG. 3 and illustrates another embodiment of the device of this invention.

For example, reference is now made to FIG. 9 wherein another control device of this invention is generally indicated by the reference numeral 20A and parts thereof similar to the device 20 previously described are indicated by like reference numerals followed by the reference letter "A".

As illustrated in FIG. 9, the device 20A is substantially identical to the device 20 previously described except that the second contact means 25A of the switch means 23A has a conductive arm 99 provided with one end 100 secured to the switch blade 49A and the other end 101 thereof carrying a contact 102 which is disposed spaced from the contact 55A. In this manner, the contact 56A of the switch blade 58A is disposed intermediate the contacts 55A and 102 to contact the same as follows.

The bimetal member 58A warps on decreasing temperature to cause the same to place the contact 56A against the contact 55A in the same manner as the device 20 previously described. However, upon increasing temperature, the bimetal member 58A warps away from the contact 55A and should the same reach a certain high temperature above the selected low temperature (as determined by the predetermined spacing between the contacts 101 and 55A) the bimetal blade 58A will place the contact 56A against the contact 102 and thereby cause the device 20A to have the plugged in indicator lamp thereof lit when that certain high temperature has been reached as well as have that indicator lamp lit when the selected low temperature is reached.

Therefore, it can be seen that this invention not only provides a new device for indicating that a sensed temperature has reached a certain selected level, but also this invention provides a new method of making such a device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a device for indicating that a sensed temperature has reached a certain selected level, said device comprising a housing means carrying an electrical switch means for operating an indicator means to one condition thereof when said switch means is closed and to another condition thereof when said switch means is open, said switch means comprising a first movable contact means and a second movable contact means which when in contact with each other close said switch means and when out of contact with each other open said switch means, said first contact means having means for moving the same relative to said second contact means in relation to said sensed temperature, and selector means rotatably carried by said housing means for selecting said certain level and having setting means operatively interconnected to said second contact means to position the same relative to said first contact means in relation to the selected level, the improvement wherein said selector means and said setting means comprise a one-piece selector member having a peripheral cam surface engaging said second contact means to position said second contact means relative to said first contact means as said cam surface is rotated by the rotation of said selector member selecting said certain level, said selector member having a substantially cylindrical portion provided with opposed ends, said housing means having a cylindrical projection provided with an internal annular surface, said cylindrical projection telescopically receiving one of said ends of said cylindrical portion therein to rotatably mount said selector member to said housing means by said one end rotatably engaging said internal annular surface of said cylindrical projection, said housing means having a snapfit projection extending concentrically out of said cylindrical projection in radially inwardly spaced relation to said internal annular surface of said cylindrical projection, said cylindrical portion having an opening passing therethrough and through said ends thereof, said snap-fit projection extending into said opening and being snap-fitted to the other of said ends of said cylindrical portion.

2. A device as set forth in claim 1 wherein said cam surface has a lobe means thereon for forcing said second contact means against said first contact means regardless of the sensed temperature when said selector member is rotated to a test position thereof.

3. A device as set forth in claim 1 wherein said housing means has an arcuate slot therein that is exposed to the exterior of said housing means, said selector member having a handle portion thereof extending out of said slot to be grasped for rotating said selector member.

4. A device as set forth in claim 3 wherein said housing means has a temperature scale thereon adjacent said slot to be viewed from the exterior of said housing means, said handle portion comprising a pointer means for indicating the selected temperature level by its position relative to said scale.

5. A device as set forth in claim 4 wherein a disc is carried by said housing means and is disposed behind said slot to cover said slot, said disc having an opening therethrough and through which said handle portion projects whereby movement of said handle portion causes said disc to move therewith.

6. A device as set forth in claim 5 wherein said disc is rotatably mounted on said cylindrical projection of said housing means by said opening of said disc telescopically receiving said cylindrical projection therethrough.

7. A device as set forth in claim 5 wherein said disc is rotatably mounted on said cylindrical portion of said selector member by said opening of said disc telescopically receiving said cylindrical portion therethrough.

8. A device as set forth in claim 1 wherein said second contact means comprises a pair of spaced apart contacts respectively disposed on opposite sides of said first contact means.

9. A device as set forth in claim 1 wherein said first contact means comprises a bimetallic switch blade having opposed ends one of which is secured to said housing means whereby said bimetallic switch blade comprises said means for moving said first contact means relative to said second contact means in relation to said sensed temperature.

10. A device as set forth in claim 9 wherein said second contact means comprises a flexible metallic switch blade having opposed ends one of which is secured to said housing means, said flexible switch blade having a normal bias toward said cam surface whereby said second contact means is always in engagement with said cam surface.

11. A device as set forth in claim 1 wherein said opening of said cylindrical portion of said selector member defines an internal peripheral surface thereof that is radially outwardly spaced from said snap-fit projection throughout the entire length of said cylindrical projection.

* * * * *